US005131169A

United States Patent [19]

Jaster

[11] Patent Number: 5,131,169

[45] Date of Patent: Jul. 21, 1992

[54] VACUUM-ASSISTED RAPID FABRIC DRYER AND METHOD FOR RAPIDLY DRYING FABRICS

[75] Inventor: Heinz Jaster, Schenectady, N.Y.

[73] Assignee: General Electric Company, Schenectady, N.Y.

[21] Appl. No.: 643,628

[22] Filed: Jan. 22, 1991

[51] Int. Cl.[5] ..... F26B 5/04

[52] U.S. Cl. ..... 34/15; 34/92; 34/133 K; 34/53; 34/133 L

[58] Field of Search ..... 34/92, 133 K, 15, 48, 34/53, 242, 133 L, 133 M

[56] References Cited

U.S. PATENT DOCUMENTS

| | | | |
|---|---|---|---|
| 3,030,712 | 4/1962 | Lambert | 34/92 |
| 3,229,382 | 1/1966 | Lambert | 34/92 |
| 3,308,553 | 3/1967 | Lambert | 34/92 |
| 4,057,907 | 11/1977 | Rapino et al. | 34/92 |
| 4,447,965 | 5/1984 | Bray | 34/83 |
| 4,615,125 | 10/1986 | Wyborn | 34/133 |
| 4,817,298 | 4/1989 | Toma | 34/133 |

*Primary Examiner*—Henry A. Bennet
*Assistant Examiner*—Denise L. F. Gromada
*Attorney, Agent, or Firm*—Patrick R. Scanlon; James C. Davis, Jr.; Paul R. Webb, II

[57] ABSTRACT

A vacuum-assisted drying apparatus and method are provided for rapidly drying fabrics. A rotatable drum is enclosed in a nearly hermetic region. A valve is attached to an inlet of the region; a compressor is attached to an exit of the region. With the valve closed, the compressor reduces the pressure within the region to the saturated pressure of water at the temperature of the fabrics. At this point, free moisture in the fabrics evaporates. Continued operation of the compressor removes the vaporous moisture from the system. After most of the free water vapor has been depleted, the valve is opened to allow heated air to flow through the drum and to dry the remaining bound moisture.

16 Claims, 1 Drawing Sheet

VACUUM-ASSISTED RAPID FABRIC DRYER AND METHOD FOR RAPIDLY DRYING FABRICS

BACKGROUND OF THE INVENTION

This invention relates generally to a fabric or clothes dryer and more particularly concerns a vacuum-assisted dryer which can dry fabrics or clothes more quickly than conventional dryers.

Conventional household dryers, such as that described in U.S. Pat. No. 4,817,298, assigned to the same assignee as the present invention, include a drum for receiving clothes or other fabrics to be dried which is rotatable about a horizontal axis. During operation, the drum is rotated to tumble the fabrics while heated air is passed through the drum to extract moisture from the fabrics.

When a piece of fabric is laden with moisture, the water in the fabric is believed to exist in two different states, free moisture and bound moisture. Free moisture is moisture which is not held with any significant adhesive force in the fabric. In fact, as far as evaporation is concerned, the free moisture at the surface of the fabric behaves just like a free surface of water. Thus, the free moisture freely evaporates at the saturation pressure of water at the fabric temperature. On the other hand, bound moisture is held by relatively strong molecular forces. The net result of these forces is that the bound moisture is not maintained as a free layer of water at the surface of the fabric and hence does not freely evaporate at the saturation pressure. Bound moisture comprises about 25% of the mass of the wet fabric.

When wet fabrics are exposed to a warm flow of air in a conventional dryer, three periods of drying are discerned. The first period is a "warm up" period where the fabrics and their moisture content reach a steady drying temperature. During the second period, called the "constant rate" period, the free moisture is dried at a constant rate. After all the free moisture is depleted, the third or "falling rate" period begins. In this period, the bound moisture is removed at a decreasing drying rate. This drying cycle is a relatively lengthy process which takes longer than the washing cycle of domestic washing machines. This difference can create an inconvenience to persons doing multiple loads of laundry in that the washing machine will often be sitting idle holding wet clothes from a finished cycle because the dryer is still drying a previous load.

SUMMARY OF THE INVENTION

Accordingly, it is an object of the present invention to overcome the above-mentioned drawbacks by providing closely matched washing and drying cycles.

More specifically, it is an object of the present invention to provide a vacuum-assisted fabric dryer which permits rapid drying.

In addition, it is an object of the present invention to provide a method of rapidly drying fabrics.

These and other objects are accomplished in the present invention by providing a dryer having a drum which is enclosed in a shell forming a nearly hermetic region and a compressor attached to an exit port of the shell. An inlet port to the shell is equipped with a valve for selectively closing the port. When the valve is closed, the compressor is capable of removing air and water vapor from the shell thereby reducing the pressure within the shell. When pressure has been reduced to the saturated pressure of water at the temperature of the fabrics, free moisture in the fabrics evaporates. Continued operation of the compressor removes the vaporous moisture from the system. After most of the vaporous moisture has been removed, the valve is opened to allow heated air to flow through the drum and to dry bound moisture in the conventional fashion.

Other objects and advantages of the present invention will become apparent upon reading the following detailed description and the appended claims and upon reference to the accompanying drawings.

DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figures in which:

DETAILED DESCRIPTION OF THE INVENTION

Figure 1:
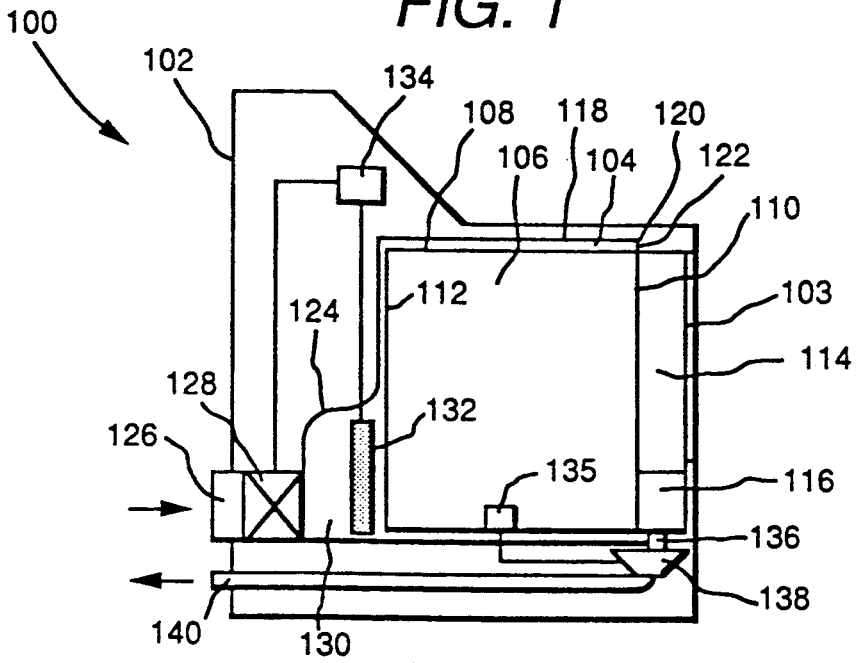
FIG. 1 is a schematic plan view of a preferred embodiment of the present invention.

Referring now to FIG. 1, there is illustrated a domestic clothes or fabric dryer generally indicated by reference numeral 100. The dryer 100 is provided, in the usual way, with a housing 102 having front and rear walls, top and bottom panels and two side walls. A substantially cylindrical shell 104 is rigidly mounted in the housing 102 with its longitudinal axis disposed horizontally. A cylindrical fabric tumbling drum 106 is mounted concentrically within the shell 104 for rotation about a generally horizontal axis. The drum 106 comprises an imperforate outer cylindrical wall 108 and an open front side defining a circular rim 110. When the dryer is assembled, the drum opening is in spaced alignment with an opening in the front wall of the housing 102 permitting fabrics to be loaded into and removed from the dryer. The opening in the housing is covered by a hinged door 103 on the front wall of the housing. The door 103 has a conventional sealing member (not shown) attached thereto for forming a seal between the door and the front wall when the door is closed. The drum 6 includes a rear wall 112 which is perforated to admit air to flow through the drum. A plurality of inwardly protruding ribs (not shown) are provided on the interior of the cylindrical wall 108 to lift fabrics and cause them to tumble as the drum rotates.

The open front side of the drum 106 is positioned in the housing slightly behind the front wall of the housing 102. The space between the circular rim 110 of the drum 106 and the front wall is bridged by a unitary seal support structure or intermediate bridge member 114. The bridge member 114 forms a rotating seal with the circular rim 110 of the drum 106 and also fits snugly around the opening in the front wall of the housing 102. Therefore, the bridge member 114 defines a sealed region when the door 103 is closed while permitting access to the interior of the drum 106 when the door is opened. The lower portion of the bridge member 114 is provided with a lint filter assembly 116. The assembly 116 provides an outlet for permitting air to exit the drum via the bridge member 114. The bridge member 114, which by itself does not constitute an inventive portion of the present invention, is fully described in the above mentioned U.S. Pat. No. 4,817,298 which is hereby incorporated by reference.

The shell 104 comprises an imperforate hollow cylindrical body 118 which has an inside diameter slightly larger than the outside diameter of the drum 106. The front of the cylindrical body 118 defines a circular rim 120. The drum 106 is positioned in the stationary shell 104 so that the circular rim 110 of the drum is aligned in the same vertical plane as the circular rim 120 of the shell. A rotating seal 122 is provided between the circular rim 110 of the drum and the circular rim 120 of the shell.

The rear of the cylindrical body 118 is closed off by a rear wall 124. The rear wall 124 is imperforate except for an inlet 126 located in the bottom portion of the rear wall 124. The inlet 126 provides an air passage into the shell. A valve 128 is situated in the inlet 126 for the purpose of opening and closing the inlet. When the valve 128 is open, air is permitted to enter the shell 104 through the inlet 126 and, by means of the perforated rear wall 112, enters the drum 106. When the valve 128 is closed, the shell 104 forms an substantially airtight region.

The bottom portion of the rear wall 124 is curved outwardly to form a cavity 130. An electrical heating element 132 is disposed in the cavity 130 adjacent to the rear of the drum 106 and the inlet 126. Due to its proximity to the drum 106, the heating element 132 is able to heat the contents of the drum. The heating element is also positioned to heat incoming air when the valve 128 is open. A timer 134 located in an upper portion of the housing 102 provides a control signal for activating and inactivating the heating element 132. The timer 134 also controls the opening and closing of the valve 128.

An outlet conduit 136 is attached to the outlet of the lint filter assembly 116. All air exiting the drum 106 and shell 104 via the assembly 116 is funnelled through the outlet conduit 136. The conduit directs the air flow into a compressor 138, the inlet of which is attached to the other end of the conduit 136. The output of the compressor 138 is directed out of the dryer at the rear of the housing 102 by an exhaust duct 140. The compressor 138 is controlled by a thermal switch 135 which senses the temperature of the fabrics in the drum 106. The switch 135 activates the compressor 138 when a preset temperature is reached.

In operation a user places wet clothes in the dryer 100 through the door 103, closes the door and starts the dryer. The timer 134 initially causes the valve 128 to close, activates the heating element 132 and starts drum rotation. Once the fabric temperature has reached the preset temperature, preferably 170° F., the thermal switch 135 activates the compressor 138. With the valve closed and the compressor operating, the pressure in the drum is reduced to the saturation pressure of water. At the saturation pressure, the free moisture in the fabrics vaporizes. The water vapor is removed from the drum through the lint filter assembly 116 by the compressor 138 and exhausted out of the dryer through the exhaust duct 140. At the preferred temperature of 170° F., the saturated temperature of water is approximately 6 psi or 2/5 atmospheres. Thus, a compressor with a compression ratio of about 5:2 will be needed.

Once the free moisture is removed, the remaining bound moisture must be removed by conventional drying methods. The point at which the free moisture is removed can be determined by an estimated time interval. After an estimated interval has elapsed, the timer outputs a signal to open the valve 126 and reactivate the heating element 132. Hot air can now be drawn through the drum by the compressor 138 and the remaining drying is completed in conventional fashion.

Figure 2:
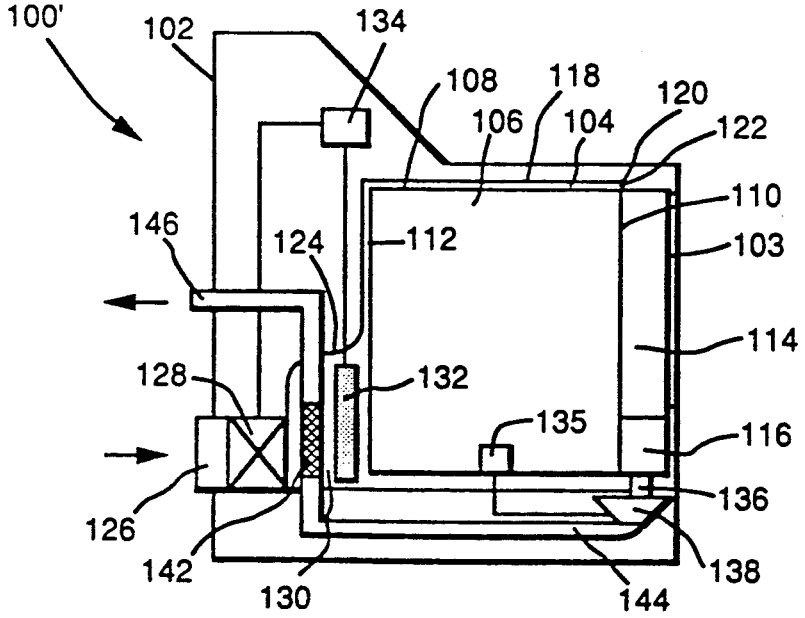
FIG. 2 is a schematic plan view of another preferred embodiment of the present invention.

Turning now to FIG. 2, a dryer 100' of a second embodiment is shown in which elements identical to those in FIG. 1 are denoted by the same reference numerals. The second embodiment differs from the first embodiment in that the output of the compressor 138 is not directly exhausted out of the dryer. The vapor drawn out of the drum 106 by the compressor will be at a significantly higher temperature than it was when in the drum because it is compressed to a higher pressure. The heat from this high temperature vapor can be recouped by using it to heat the contents of the drum, thus making the dryer more efficient. A heat exchanger 142 is situated in the cavity 130 adjacent to the heating element 132. A connecting duct 144 directs hot vapor exiting the compressor 138 to the heat exchanger 142. The heat exchanger can then heat the air entering the system through the inlet 126, thereby reducing the load on the heating element 132. An exhaust duct 146 attached to the outlet of the heat exchanger provides an outlet from the dryer.

While specific embodiments of the present invention have been described, it will be apparent to those skilled in the art that various modifications thereto can be made without departing from the spirit and scope of the invention as defined in the appended claims.

What is claimed is:

1. A fabric dryer comprising:

a substantially hermetic receptacle for holding fabrics to be dried, said receptacle having an inlet and an outlet;

a valve attached to said inlet for selectively closing and opening said inlet;

timer means for controlling the opening and closing of said valve;

a compressor attached to said outlet for drawing air out of said receptacle, thereby reducing pressure in said receptacle when said valve is closed; and heating means disposed adjacent to said receptacle and said inlet for heating both the contents of said receptacle and air entering through said inlet.

2. The dryer of claim 1 wherein said receptacle comprises an outer shell and a perforated drum, said drum being mounted in said shell for rotation about a horizontal axis.

3. The dryer of claim 1 further comprising an exhaust duct connected to said compressor for exhausting air from the dryer.

4. The dryer of claim 1 further comprising a heat exchanger connected to said compressor and disposed adjacent to said inlet so that air entering through said inlet is heated by said heat exchanger.

5. The dryer of claim 4 further comprising an exhaust duct connected to said heat exchanger for exhausting air from the dryer.

6. The dryer of claim 1 further comprising a thermal switch means for sensing the temperature of the fabrics in said receptacle, and activating said compressor when a preset temperature is reached.

7. A fabric dryer comprising:

a housing;

a substantially hermetic shell mounted in said housing;

a fabric receiving drum mounted in said shell for rotation about a horizontal axis, said drum having a perforated section to allow air flow therethrough;

an air inlet means for introducing air into said shell, said air inlet means capable of being switched between open and closed positions;

a timer means for controlling the switching of said air inlet means between open and closed positions;

a heating means disposed within said shell for heating the interior of said shell;

an air outlet means for exhausting air from said shell; and a compressor attached to said air outlet means for drawing air out of said shell and said drum, thereby reducing pressure in said shell and said drum when said air inlet means is switched to the closed position.

8. The dryer of claim 7 wherein said heating means is located near said air inlet means in order to heat incoming air.

9. The dryer of claim 7 further comprising an exhaust duct connected to said compressor for exhausting air out of said housing.

10. The dryer of claim 7 further comprising a heat exchanger connected to said compressor and disposed adjacent to said air inlet means so that air entering through said air inlet means is heated by said heat exchanger.

11. The dryer of claim 10 further comprising an exhaust duct connected to said heat exchanger for exhausting air out of said housing.

12. The dryer of claim 7 further comprising a thermal switch means for sensing the temperature of the fabrics in said drum, and activating said compressor when a preset temperature is reached.

13. A method of drying fabrics comprising:

placing the fabrics to be dried into a drying receptacle having an inlet which can be selectively opened and closed;

closing said inlet;

heating the interior of said receptacle until the fabrics reach a preset temperature;

reducing the pressure in said receptacle to the saturation pressure of water at the preset temperature so that the free moisture in the fabrics vaporizes;

removing the vaporized moisture from said receptacle;

opening said inlet; and causing hot air to flow through said receptacle.

14. The method of claim 13 further comprising continuously tumbling the fabrics after the fabrics to be dried have been placed into said drying receptacle.

15. The method of claim 13 wherein the step of reducing the pressure in said receptacle comprise drawing air from said receptacle while said inlet is closed.

16. A fabric dryer having a vacuum drying mode and a hot air mode comprising:

a substantially hermetic receptacle for holding fabrics to be dried, said receptacle having an inlet;

a valve attached to said inlet for selectively closing and opening siad inlet;

means for drawing air out of said receptacle, thereby reducing pressure in said receptacle when said valve is closed; and means for heating air entering through said inlet;

whereby said dryer is in its vacuum drying mode when said valve is closed in it shot air drying mode when said valve is open.

* * * * *

UNITED STATES PATENT AND TRADEMARK OFFICE

CERTIFICATE OF CORRECTION

PATENT NO. : 5,131,169

DATED : July 21, 1992

INVENTOR(S) : Heinz-NMN-Jaster

It is certified that error appears in the above-indentified patent and that said Letters Patent is hereby corrected as shown below:

COLUMN 6

In claim 15, line 2, "comprise" should be --comprises--.

In claim 16, line 2, "hot air mode" should be --hot air drying mode--.

In claim 16, line 6, "siad" should be --said--.

In claim 16, line 12 "in it shot" should be --and in its hot--.

Signed and Sealed this

Seventh Day of September, 1993

Bruce Lehman

*Attest:*

BRUCE LEHMAN

*Attesting Officer*

*Commissioner of Patents and Trademarks*